US005192182A

United States Patent [19]

Possell

[11] Patent Number: 5,192,182

[45] Date of Patent: Mar. 9, 1993

[54] SUBSTANTIALLY NOISELESS FAN

[76] Inventor: Clarence R. Possell, 11618 Placid Ct., Colton, Calif. 92324

[21] Appl. No.: 763,258

[22] Filed: Sep. 20, 1991

[51] Int. Cl.[5] ..... F01D 1/36

[52] U.S. Cl. ..... 415/90; 415/203; 415/182.1; 415/143

[58] Field of Search ..... 416/223 B; 415/90, 203, 415/206, 182.1, 208.1, 183, 143

[56] References Cited

U.S. PATENT DOCUMENTS 2,031,734 2/1936 Riebel et al. ..... 415/143
2,632,598 3/1953 Wales ..... 415/90
3,368,744 2/1968 Jenn ..... 415/208.1
4,768,920 9/1988 Gurth ..... 415/90

*Primary Examiner*—Edward K. Look
*Assistant Examiner*—Mark Sgantzos
*Attorney, Agent, or Firm*—John H. Crowe

[57] ABSTRACT

A noiseless fan having a group of parallel and thin, closely spaced disks rotatable at relatively high speed. As the disks rotate, boundary layers of air on the disk surfaces rotate bodies of air between the disks while centrifugal force developed by the rotating disks drives the air radially outward to be expelled into the atomosphere. Intake air is admitted axially through central openings in the disks and is directed radially outward into the spaces between the disks to displace the expelled air.

1 Claim, 1 Drawing Sheet

SUBSTANTIALLY NOISELESS FAN

BACKGROUND OF THE INVENTION

1. Field of the Invention

This invention relates generally to motor driven fans for moving air and more particularly to a motor driven substantially noiseless fan.

2. Description of the Prior Art

Heretofore, motorized fans have, in general, comprised rotary members having a plurality of radially extending blades which form lifting or shoving surfaces effective to drive the air either axially as in the case of propeller fans or radially outwardly as in the case of centrifugal fans. In either case, the blades, when stricking the air, tend to agitate or churn portions of the air driven thereby to create noise and bring about reduced fan efficiency.

SUMMARY OF THE INVENTION

According to the present invention, a motor-driven fan is provided comprising a plurality of thin annular disks which are closely spaced and adapted to be rotated at a relatively high speed. When the fan is running, a body of air between each pair of facing disks is rotated about the disk axes by virtue of boundary layers of the air on the facing sides of the disks. This air body tends to shear radially outwardly due to centrifugal force and thus move in a spiral path toward the outer peripheries of the disks, from where it is dispersed to the atmosphere. At the same time, air is drawn axially into center openings in the disks by the radially outwardly moving air bodies between said disks. By providing a plurality of such rotating disks, a relatively large quantity of air can be moved through the fan without any appreciable noise.

It is thus a principal object of the present invention to provide a substantially noiseless fan.

Another object of the invention is to provide such a fan without any inherently noisy and dangerous fan blades of conventional type.

Still another object of the invention is to provide such a fan of relatively simple and inexpensive character.

Yet another object of the invention is to provide such a fan adapted for use in the transfer of air to or from a room or other enclosure.

BRIEF DESCRIPTION OF THE DRAWING

The manner in which the above and other objects of the invention are accomplished can be readily understood from the following specification when read in conjunction with the accompanying drawing, wherein.

DESCRIPTION OF THE PREFERRED EMBODIMENT

Figure 1:
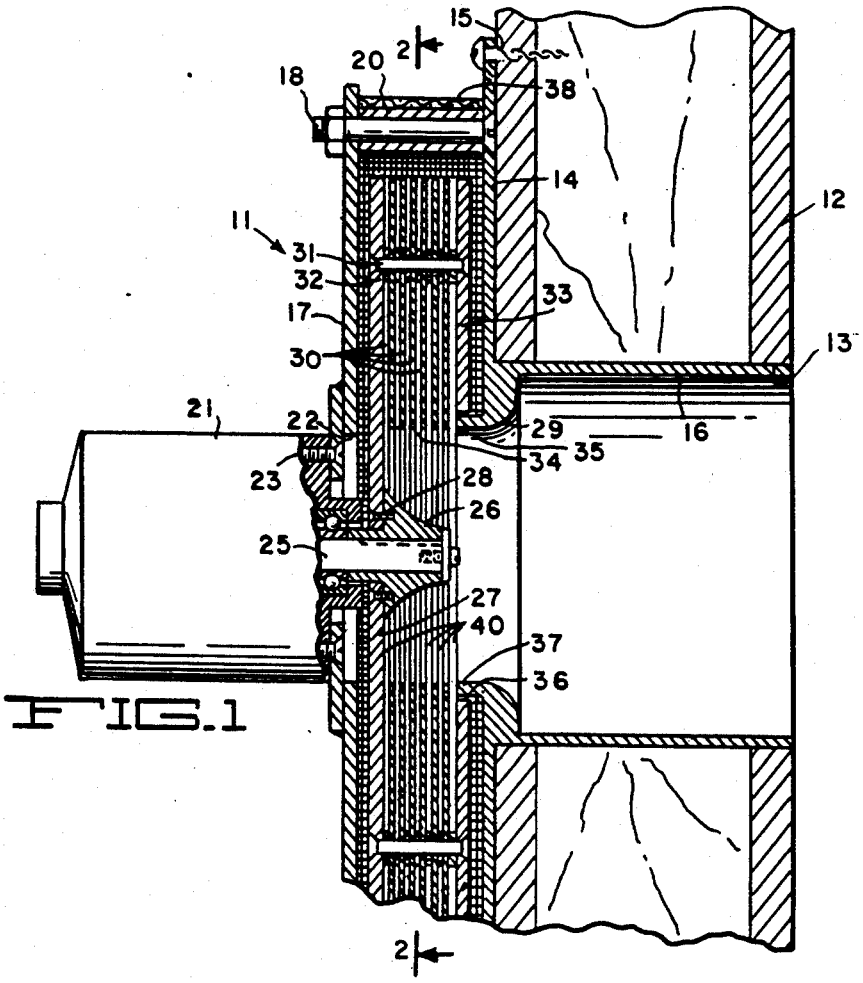
FIG. 1 is a sectional elevational view, partly broken away, of a substantially noiseless fan embodying a preferred form of the present invention.
Figure 2:
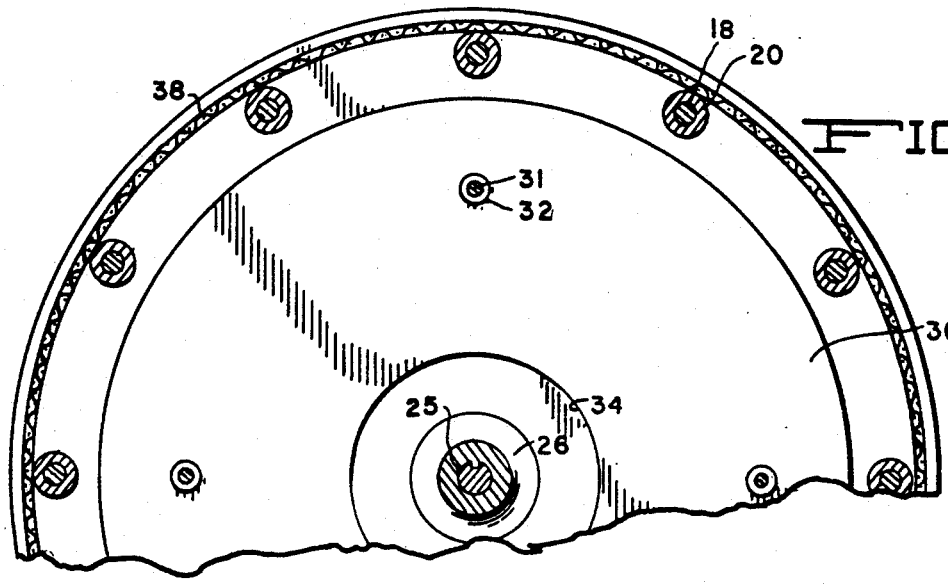
FIG. 2 is a transverse sectional view of the fan, partly broken away, taken along line 2—2 of FIG. 1.

Referring now to the drawing, the illustrated fan is generally indicated at 11 and is shown removably secured to a wall 12 of a room or the like which has a cylindrical opening 13 extending therethrough. Fan 11 is supported by a base plate 14 secured to the wall 12 by means of screws, one of which is shown at 15.

A motor base plate 17 is supported in spaced parallel relationship with plate 14 by stand-off bolts 18 surrounded by sleeves 20 which are interposed between the plates 14 and 17. A cylindrical air intake conduit 16 secured to plate 14 extends through the cylindrical wall opening 13.

A relatively high speed fan motor 21 is positioned within a central opening 22 in the plate 17 with the aid of screws 23 and its shaft 25 has suitably secured thereto a semihyperboloidal hub 26 to which a disk or flange 27 is secured by means of screws 28.

A plurality of thin annular impeller disks 30 are mounted on the flange 27 in axial alignment with each other and with the motor 25 by rivets 31. Thin spacers 32, surrounding the rivets 31, space the disks 30 a short distance apart and from the flange 27. Typically, this distance can be 0.06 inch. An annular disk or flange 33 is also supported in axial alignment with the disks 30 by rivets 31. The outer peripheries of the disks 30 and flanges 27 and 33 are of similar diameters.

The disks 30 all have central openings 34 of the same diameter which are aligned with a circular outlet opening 35 of the intake conduit 16. The outlet opening 35 is of the same diameter as the disk openings 34 and the portion of intake conduit 16 intermediate the main part of its interior and the opening 35 is rounded convexly as indicated at 29 to insure a smooth flow of air therethrough.

The flange 33 has a central opening 36 which is somewhat larger in diameter than the disk openings 34 and encircles, in close proximity, a thin annular lip 37 extending inwardly from the base plate 14. The inner end of lip 37 is coplanar with the inner side of the flange 33.

A cylindrical screen 38 is fitted over the sleeves 20 around stand-off bolts 18 to protect the disks 30 from falling objects or the like.

When fan 11 is in operation, air is drawn through the intake conduit 16 from the right hand side of wall 12, as seen in FIG. 1, through the opening 35 and axially against hub 26 which directs the air radially outwardly into spaces 40 between the disks 30 and between the outermost disks 30 and respective ones of the flanges 27 and 33.

As previously indicated, individual bodies of air in the spaces 40 are rotated by virtue of the boundary layers of air engaging the sides of the disks 30 and flanges 27 and 33. These rotating air masses are then sheared from the boundary layers due to centrifugal force and move radially outwardly in spiral fashion and are discharged radially into the atmosphere through the screen 38. As the air is expelled from between the disks 30 and from between outer ones of the disks and respective ones of the flanges 27 and 33, incoming air is drawn in between the disks to displace the expelled air. The semihyperboloidal hub 26 serves to direct the incoming air radially outwardly into the spaces 40 between the disks 30 and between the outermost disks 30 and the flanges 27 and 33.

A better understanding of the outstanding feature of my novel fan, its capability of operating in virtually noiseless fashion, will be better understood from a comprehension of the manner in which a conventional bladed fan operates. When such a fan is in operation, much noise is created by air oscillation at the discharge side of the fan as a result of frequencies in the moving air caused by the fan blades passing the discharge opening. This can be likened to the noise created by the propeller of a small aircraft during its takeoff because both fan blades and aircraft propellers have lifting surfaces to move the surrounding air as they rotate. By contrast, my novel fan has no blades with lifting surfaces, the air it moves being accelerated outwardly purely by boundary layer drag on disk surfaces in an orderly and very smooth way so that it never gets set into oscillation. The result is an extremely quiet movement of the air.

All conventional types of devices that move or pump air exhibit lifting surface characteristics resulting in a great deal of operating noise as opposed to my novel fan which moves the air in a primarily laminar flow mode with virtually no accompanying noise. Furthermore, the latter moves the air in a substantially higher discharge flow rate than a conventional lifting surface fan does, as I have determined by actual measurements of comparative flow rates between the two types of fan. I have determined, by such flow rate measurements, that my novel fan design has resulted in a significant increase in discharge velocity while its noise level has gone down up to 100%, or more, on a logarithmic noise basis, by comparison with its conventional counterpart.

My novel fan is effective to move air at any motor speed because its boundary layer drag occurs at all velocities. Consequently, even when its motor is just beginning to turn, the fan starts pumping air. The rate of air output of course increases as the rpm of the fan motor goes up.

The following description of the construction and testing of a 40-hp motor incorporating the novel features of my fan, which I was asked to do by a fan manufacturer, illustrates the outstanding improvement of my novel fan over the conventional bladed fan. In constructing my prototype for this test, I substituted my disk system for a 4-bladed fan in a production model marketed by the aforesaid manufacturer. My novel disk mechanism was mounted in place of and on the same shaft as the fan unit in the production model to yield my prototype, and the motor was turned at the same rpm for comparative runs of the production model with its conventional fan system and my modified version thereof. The bladed production novel was tremendously noisy because of the blade lifting surfaces going past its discharge opening many times a second to create a noise level with that frequency. This comparative test procedure resulted in a 100% reduction in decibels of my prototype by comparison with the commercial fan with the four blades. The comparison also showed that with my novel prototype there was a substantial reduction in the amount of power necessary to drive the fan and a substantial increase in the amount of cooling air discharged therefrom, compared to the power consumption and discharge air flow from the production model of the fan. This improved performance on the part of my prototype resulted in a very significant reduction in the heating of the operating fan motor.

As those skilled in the art will appreciate, excessive heat is the enemy of an electric motor or generator and the cooling effect of my air moving disks on their driving motor constitutes an important improvement of my novel fan over a conventional fan system with its fan blade lifting surfaces. The lower the generated heat in a fan motor, the less damage to insulation, etc., results when the fan is in operation. The 40-hp motor employed for the above-described test was a fairly large, heavy motor and one of the noisiest motors that the aforesaid manufacturer produced, which was why it was picked for the test comparison just described.

I claim:

1. A substantially noiseless fan for moving air comprising;

a first housing part forming a first wall;

a second housing part forming a second wall;

means on said first housing part supporting said second housing part with said second wall in spaced relationship with said first wall to form a partial enclosure which is open at its periphery to the atmosphere;

a rotatable drive shaft;

bearing means rotatably supporting said drive shaft partially within said partial enclosure;

a first disk in said partial enclosure carried by said shaft;

a second disk in said partial enclosure having a central opening therein;

a plurality of disks, each with a central opening therein of the same size, positioned in parallel relationship with the first and second disks;

said second housing part having an air intake opening coaxial with said central opening in said second disk;

said second housing part including a substantially tubular extension sized to slidingly extend through a receptive cylindrical opening in a structure wall, said substantially tubular extension comprising an air intake conduit terminating coaxially with said central opening;

said tubular extension having an annular lip extending within said air intake opening in said second housing part;

the central openings in said second disk and in said plurality of disks being all round openings of substantially the same diameter;

the inside diameter of said annular lip being substantially the same as the diameter of each of the central openings in said plurality of disks, and said fan including means forming a throat intermediate said lip and the remainder of said substantially tubular extension, said throat having a smaller cross sectional area throughout than the cross sectional area of the interior of said remainder of said substantially tubular extension;

said throat narrowing convexly from the remainder of said substantially tubular extension to said lip;

said substantially noiseless fan including a cylindrical screen encircling said first disk, said second disk and said plurality of disks spaced outwardly therefrom between said first wall and said second wall; and means supporting said second disk and said plurality of disks in spaced parallel and rotational relationship with said first disk and each other whereby when the disks are rotated at a suitable speed bodies of air in the spaces therebetween are rotated due to boundary layers of the air on the facing sides of said disks and portions of said bodies of air are sheared from said boundary layers and moved radially outward in spiral paths by centrifugal force created by said rotation.

* * * * *